United States Patent [19]

Washchynsky et al.

[11] Patent Number: 4,461,209

[45] Date of Patent: Jul. 24, 1984

[54] INK PUMP WITH POSITIVE ZERO SET

[75] Inventors: Bohdan Washchynsky, Overland Park, Kans.; Ralph L. Fusco, Commack, N.Y.

[73] Assignee: Smith R.P.M. Corporation, Overland Park, Kans.

[21] Appl. No.: 397,689

[22] Filed: Jul. 13, 1982

[51] Int. Cl.[3] ..... B41F 31/08; B41L 27/10

[52] U.S. Cl. ..... 101/219; 101/365; 101/366

[58] Field of Search ..... 101/365, 366, 148, 207, 101/208–210, 219; 417/492, 500

[56] References Cited

U.S. PATENT DOCUMENTS

| | | | |
|---|---|---|---|
| 2,104,590 | 1/1938 | Hill | 417/500 |
| 2,436,492 | 2/1948 | Shepard | 417/500 |
| 2,497,648 | 2/1950 | Worthington . | |
| 2,622,523 | 12/1952 | Dressel et al. . | |
| 2,821,919 | 2/1958 | Dressel . | |
| 2,838,996 | 6/1958 | Worthington et al. . | |
| 2,866,411 | 12/1958 | Reed et al. | 101/366 |
| 2,965,023 | 12/1960 | Boule et al. . | |
| 3,057,294 | 10/1962 | Jameson | 101/365 |
| 3,065,693 | 11/1962 | Neal et al. | 101/366 |
| 3,134,325 | 5/1964 | Worthington et al. . | |
| 3,168,872 | 2/1965 | Pinkerton . | |
| 3,266,432 | 8/1966 | Wortley | 417/492 |
| 3,366,051 | 1/1968 | Fusco . | |
| 3,382,812 | 5/1968 | Smith | 417/500 |
| 3,608,486 | 9/1971 | McDonald . | |
| 3,914,073 | 10/1975 | Fusco | 417/500 |
| 3,930,447 | 1/1976 | Murray | 101/365 |
| 4,165,207 | 8/1979 | Fujikawa | 417/500 X |

*Primary Examiner*—J. Reed Fisher

*Attorney, Agent, or Firm*—Litman, Day and McMahon

[57] ABSTRACT

An ink pump adapted for use with a rotary printing press comprising four pump bodies each having individual pumping units. The pumping units include a plunger shaft which rotates and reciprocates within a sleeve having an inlet and an outlet port. The shaft includes a cut-out portion which comprises a piston surface for pumping the ink upon the reciprocation of the shaft. A sliding shoe is eccentrically positioned relative to an axis of the shaft and rides upon a movable planar wobble plate angled relative to an axis of the shaft, providing the impetus for the reciprocating motion of the shaft. When the wobble plate is rotated to a position where it is normal to an axis of the plunger shaft, a zero set adjustment screw contacts the shaft axially, prohibiting the shaft from contacting the wobble plate and reciprocating. A potentiometer registers the angular position of each wobble plate and displays the position on a control panel readout to give the use thereof a quick reference of the pumping action of each pumping unit.

12 Claims, 14 Drawing Figures

INK PUMP WITH POSITIVE ZERO SET

BACKGROUND OF THE INVENTION

This invention relates to rotary printing presses and in particular to rotary printing presses which utilize ink pumps to transmit ink to the associated press cylinders.

All rotary printing presses utilize some form of structure to apply printing ink to the plate cylinders which are associated with the printing press. Originally, this structure comprised a fountain roller which was partially immersed and rotated in an ink fountain reservoir. The ink adhered to the surface of the cylinder and was transmitted by various intermediate cylinders to the plate cylinder of the press. With this type of arrangement, it was difficult to control the amount of ink applied to the plate cylinder. Further, it was difficult and time consuming to change the color of ink which was being used by the particular press.

In response to these drawbacks, ink pumps have been designed which utilize a positive displacement pump unit to apply a controlled amount of ink to an associated inking train of the printing press. There are certain drawbacks to those ink pumps which are presently being used. One such drawback is that it is extremely difficult to adjust the individual pumping units of the ink pumps to a position where they do not pump any ink without turning off an associated motor means. This is problematical because generally, multiple pumping units are driven by a single motor means and it is usually desirous to have a certain portion of the pumping units providing ink to the ink tray with a remaining portion being silenced.

SUMMARY OF THE INVENTION

The present invention comprises an ink pump which includes a positive zero set means which allows each individual pumping unit of the ink pump to be selectively silenced.

The ink pump comprises four main pumping bodies each having a number of discrete pumping units contained therein. The pumping units each comprise a plunger shaft which both rotates and reciprocates within an associated sleeve having ink inlet and outlet ports associated therewith. The plunger shaft includes a cut-out portion at the end adjacent the inlet and outlet ports which cut-out portion defines a piston surface for pumping the ink through the pump. The other end of the plunger shaft has a sliding shoe located eccentrically relative to an axis of the shaft. The sliding shoe is continually biased into engagement with a wobble plate which is angled relative to the plunger and which thereby imparts the reciprocating action to the plunger shaft. The rotating action of the shaft comprises the valving action thereof.

The positive zero set means comprises an adjustment screw which is axially aligned with the plunger shaft and which contacts a plunger shaft end when the wobble plate is adjusted to a substantially vertical position. When the adjustment screw contacts the plunger shaft, it retains the plunger shaft in a position away from the wobble plate such that the sliding shoe never contacts the wobble plate and therefore no reciprocating action is imparted by the wobble plate to the plunger shaft. When this occurs, even though the plunger shaft is continually rotating, there is no reciprocating action associated therewith and the unit does not pump any ink therethrough.

The angular position of the wobble plate is selectively variable between a position where the wobble plate is substantially vertical and perpendicular to an axis of the plunger shaft to a position where the wobble plate is angled from approximately 20 to 30 degrees to the plunger shaft which is the maximum angle of the wobble plate and which defines the maximum stroke of the plunger. A suitable servo motor is provided and rotates a wobble plate adjustment screw to position the wobble plate in a desired angular position. The servo motor actuates a potentiometer the output of which is directly related to the angular position of the wobble plate. The potentiometer is associated with a control panel readout which informs the user of the ink pump the degree of stroke of the individual pumping unit plunger.

OBJECTS OF THE INVENTION

Therefore the objects of the invention are to provide an ink pump adapted to be used with a rotary printing press which includes a positive zero set for each individual pumping unit thereof; to provide such an ink pump which includes four pump bodies each having a plurality of individual pumping units defined by a plunger which reciprocates and rotates within a sleeve having inlet and outlet ink ports associated therewith; to further provide such an ink pump wherein the pumping action of each plunger is governed by an angular position of a wobble plate which is contacted by an eccentric sliding shoe associated with the plunger shaft; to further provide such an ink pump wherein the positive zero set comprises a screw which axially contacts an end of the plunger shaft to bias the plunger shaft sliding shoe away from the wobble plate throughout 360 degrees of rotation of the plunger shaft; to provide for such an ink pump readout means associated with each individual pumping unit to display to a user of the ink pump the position of each individual wobble plate and therefore, the amount of ink being pumped by that individual pumping unit; to provide such a readout which comprises a potentiometer activated by a servo motor which adjusts the position of each individual wobble plate; and to further provide such an ink pump which is capable of installation in both new and existing printing presses, capable of allowing a rapid purging of ink within the ink pumps, capable of allowing rapid changes in the color of ink being used by the printing press, capable of extended life, durable in use and particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
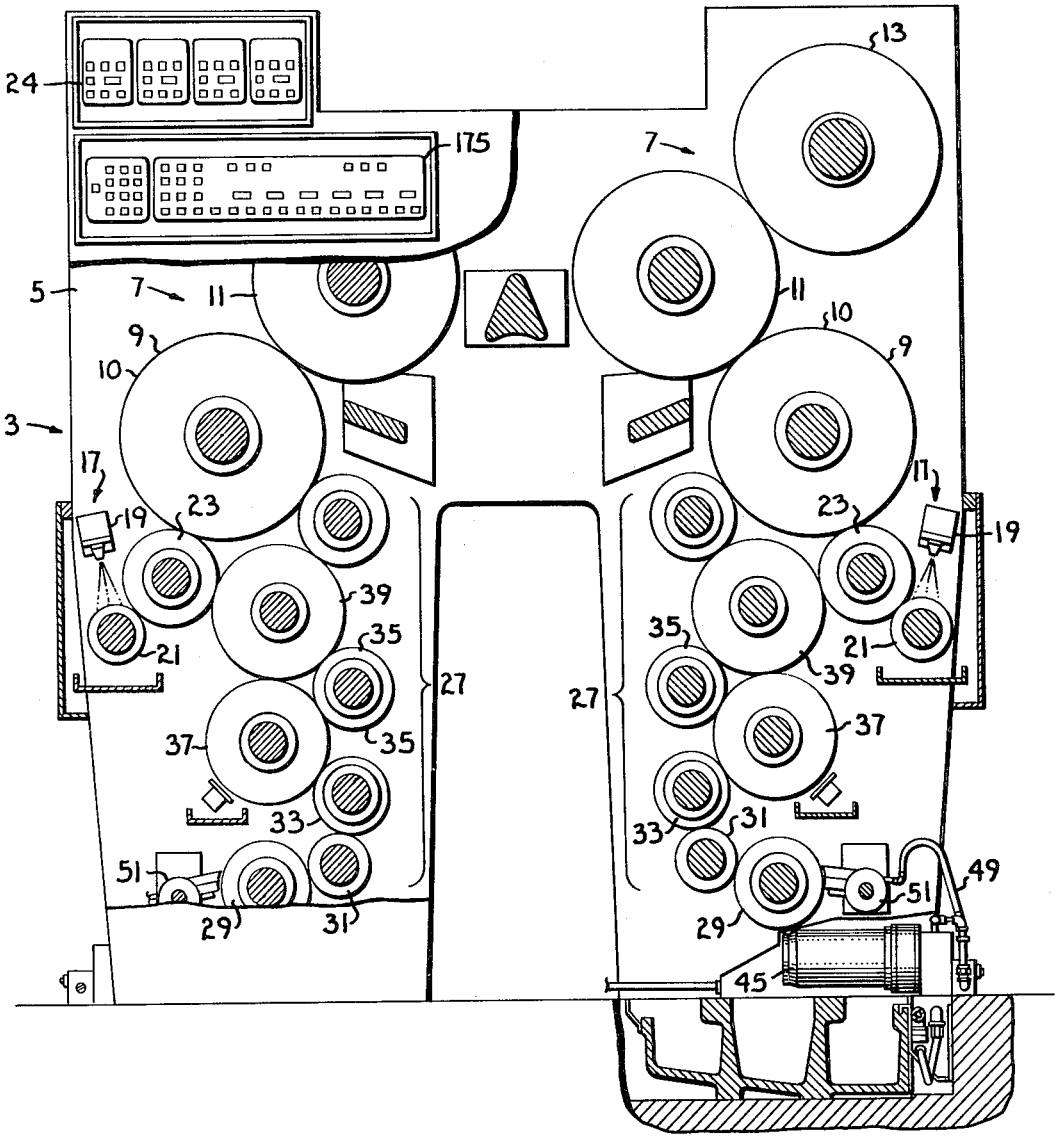
FIG. 1 is a partially schematic side elevation view of a rotary printing press showing an ink pump according to the present invetion associated therewith.

The reference numeral 1 generally designates an ink pump according to the present invention shown in FIG. 1 in operative position within a rotary printing press 3. The rotary printing press 3 includes side tower frames 5 containing therein associated rollers and cylinders. The printing press 3 comprises two printing couples 7 each including an offset plate cylinder 9, having an offset plate 10 thereon, an offset blanket cylinder 11 and an offset impression cylinder 13. A web of paper (not shown) is reeved between each of the offset blanket and impression cylinders 11 and 13 respectively to print on either or both sides of the web.

A dampening system 17 is provided and includes a spray dampener 19 which applies or sprays dampening fluid to a dampening train including rollers 21 and 23 which transfer the dampening fluid to the plate cylinder 9. A control panel 24 is provided for the dampening system 17. An inking train 27 is also provided to transfer ink to the plate cylinder 9. The inking train includes a first primary cylinder 29 upon which the ink pump 1 transfers the ink. A pick up roller 31 is positioned adjacent the primary cylinder 29 and transfers the ink to the transfer rollers 33 and 35, cylinders 37 and 39, and to the plate cylinder 9. Typically, the cylinders 37 and 39 oscillate axially to more evenly distribute the ink thereacross for better transfer and even distribution of the ink to the plate cylinder 9.

Figure 2:
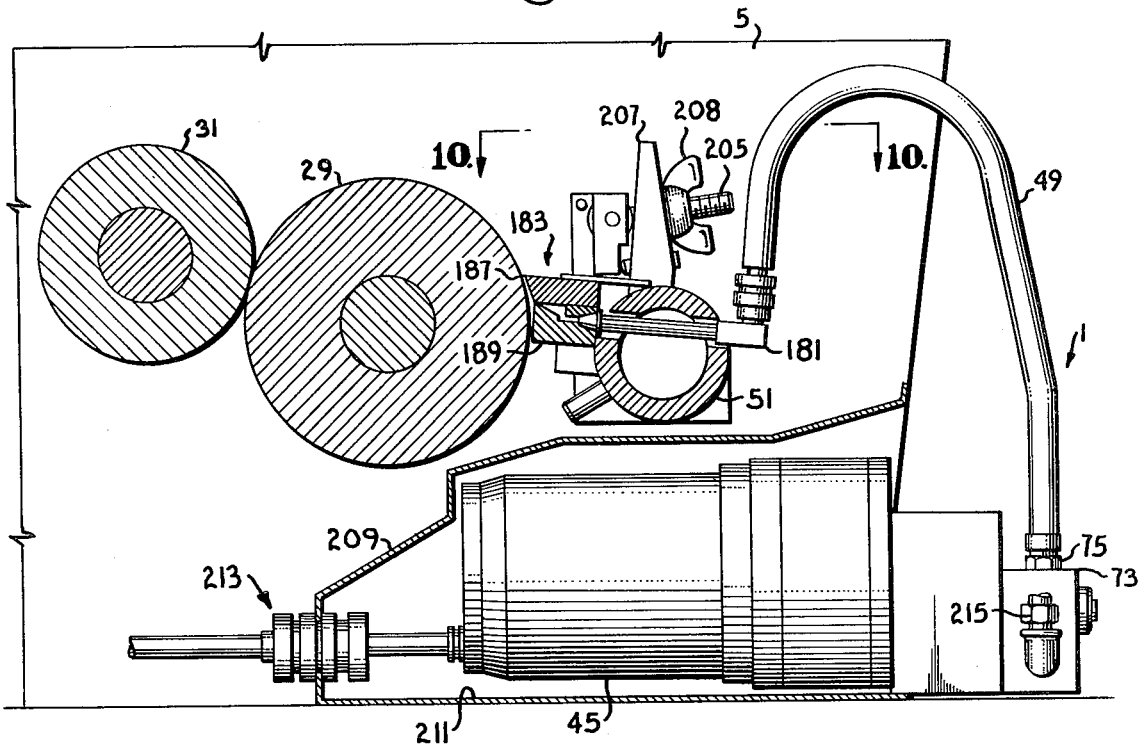
FIG. 2 is an enlarged view of a portion of the printing press shown in FIG. 1 showing the ink pump and an ink rail.

The ink pump 1 comprises four pump bodies 45 each of which includes a plurality of individual pumping units 47. The four pump bodies correspond with the number of pages which are typically printed across the web. Further, the number of pumping units 47 correspond to the number of columns across each page. Generally, this number will be six or seven. As shown in FIGS. 1 and 2, each individual pumping unit applies a given quantity of ink through suitable conduits 49 and an ink rail 51, to the primary ink cylinder 29 which is adjacent the ink rail 51.

Figure 4:
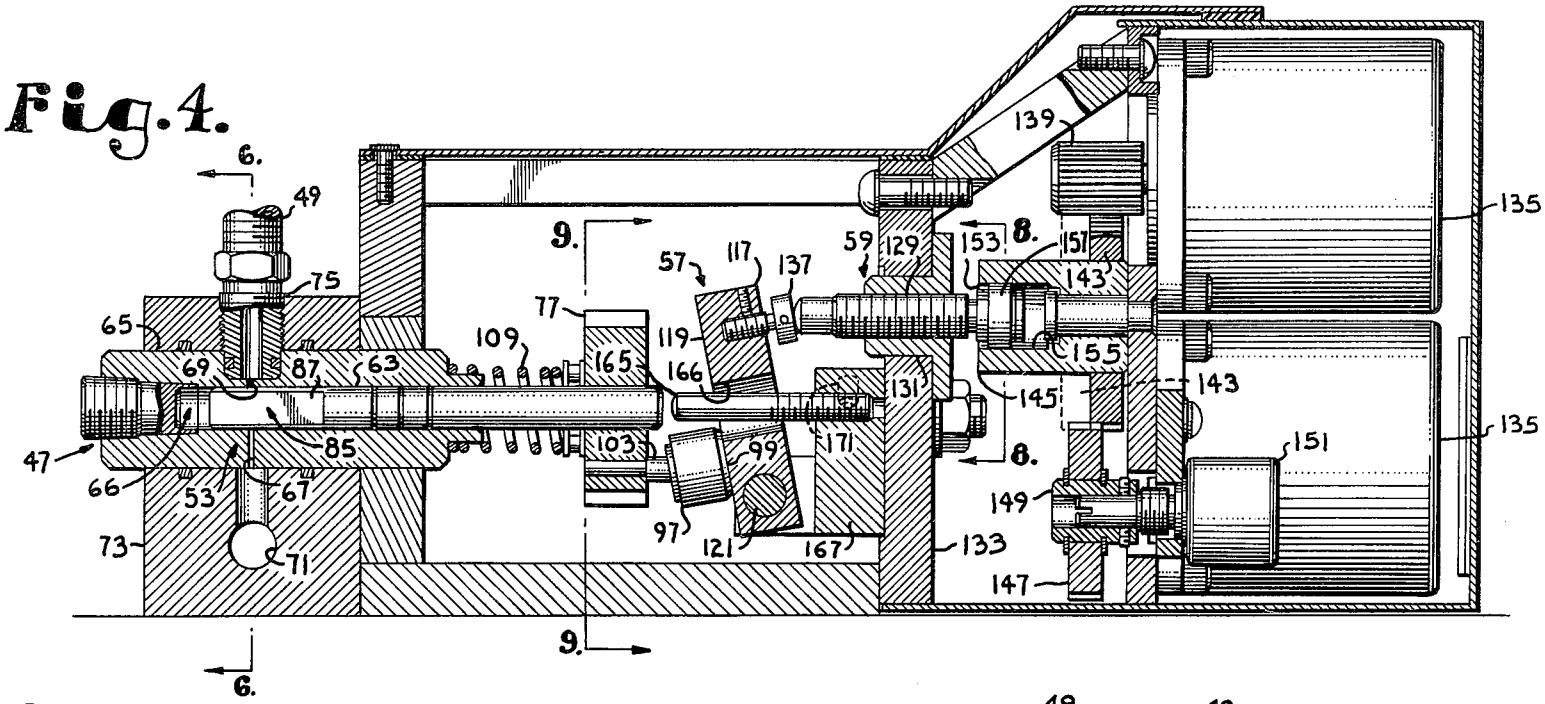
FIG. 4 is an enlarged cross-sectional view of the ink pump taken generally along lines 4—4 in FIG. 3.
Figure 5:
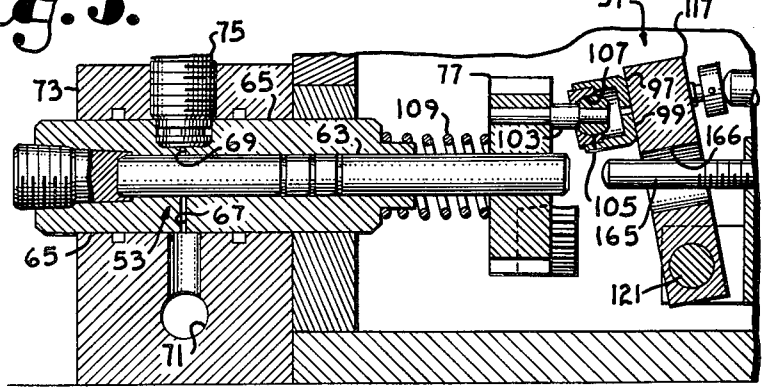
FIG. 5 is an enlarged view of a portion of the ink pump showing a plunger shaft wobble plate and zero set adjustment screw.

The individual pumping units 47 comprise a piston means 53, valve 55 means, cam means 57, and adjustment means 59 for varying the amount of ink pumped by each individual pumping unit during a given pumping sequence. As shown in FIGS. 4 and 5, the piston means 53 comprises a plunger shaft 63 which both reciprocates and rotates within a closed sleeve 65 defining a chamber 66 therein having inlet and outlet ports 67 and 69 respectively for the passage of ink therethrough. The inlet ports 67 are in ink flow communication with a passageway 71 which extends through an intake block 73 of each individual pump body. The passageway 71 communicates with a suitable supply of ink. The outlet ports 69 of each individual pump unit 47 are in ink flow communication through fittings 75 with the individual conduits 49 for transferring the ink from the pump units to the ink rail 51.

Figure 9:
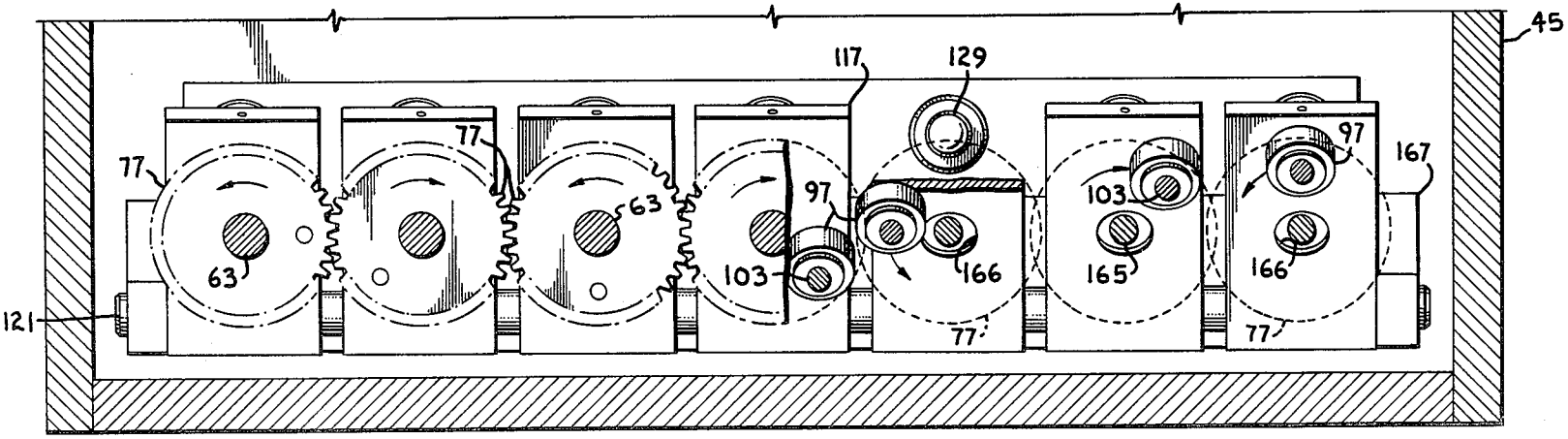
FIG. 9 is a cross-sectional view taken along line 9—9 in FIG. 4.

As indicated, the plunger shaft 63 rotates within sleeve 65. Each shaft 63 includes a spur gear 77 retained thereon by suitable means. The spur gears 77 are driven by means of synchronous DC motor 79, the speed of which is directly related to the speed of the printing press 3. An idler gear 81 is provided between an output gear 83 of the motor 79 and the spur gears 77. As seen in FIG. 9 and indicated by arrows, the direction of rotation of adjacent plungers are opposite.

Figure 6:
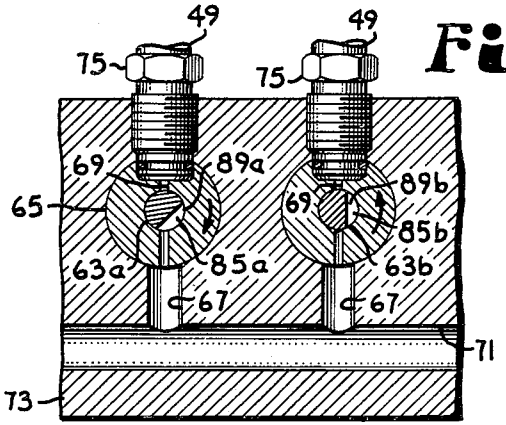
FIG. 6 is a partial cross-sectional view taken along line 6—6 in FIG. 4.

The plunger shaft 63 includes at the end adjacent the inlet and outlet port 67 and 69 a cut-away portion 85 defined by a first wall 87 which is parallel to an axis of the shaft and a second wall 89 which is normal thereto. The cut-away portion 85 comprises less than half of the plunger shaft 63. As seen in FIG. 6 when the plunger shaft 63 is rotated to a position where the first wall 87 is generally vertical, the remaining portion of the plunger shaft occludes both the inlet and outlet ports 67 and 69 respectively. As such, the rotation of the plunger shaft 63 provides the valving action for the pumping units 47.

As noted, the plunger shafts 63 also reciprocate within sleeves 65. As seen in FIG. 4, the plunger shafts each include a sliding shoe 97 which is retained on the associated spur gear 77 eccentric to the axis of the plunger shaft 63. Positioned between the spur gear 77 and the sleeve 65 is a spring 109 which continuously urges the spur gear 77 and plunger shaft 63 axially from the sleeve 65.

The sliding shoe 97 includes a planar contact surface 99 and is retained on a pin 103 protruding from the face of spur gear 77. The pin 103 includes a generally spherical head 105 which is contacted by a spherical bearing 107 of the sliding shoe 97. The sliding shoe 97 is free to articulate about the spherical pin head 105.

The cam means 57 comprises a wobble plate 117 which includes a surface 119 upon which the sliding shoe planar surface 99 rides. As seen in FIG. 5, the wobble plate 117 is pivotable about a horizontal axis transverse to and below the axis of the plunger shaft 63 with the wobble plate pivot axis being defined by a pin 121. As seen in FIGS. 4 and 5, as the plunger shaft 63 rotates, the spring 109 biases the sliding shoe 97 into continuous contact with the wobble plate surface 119. When the plunger shaft 63 is rotated to a position where the sliding shoe 97 is in a position as shown in FIG. 5, the plunger shaft 63 is at the furthest point of its inward stroke relative to the sleeve. Likewise, when the plunger shaft 63 is rotated to where the sliding shoe 97 is in a position in FIG. 4, it is in a position which represents the most outward position thereof relative to the sleeve 65. The position of the plunger shaft in FIG. 5 is at the end of the pumping stroke of plunger shaft 63, and the position of the plunger shaft in FIG. 4 represents the end of the intake stroke of the plunger shaft 63.

In FIG. 6, two plunger shafts 63*a* and 63*b* are shown with their respective direction of rotation indicated by arrows. The position of the cut-away 85*b* of shaft 63*b* corresponds with the positioning of the sliding shoe 97 as shown in FIG. 4, at which time the chamber of the pumping unit is full of ink. When the plunger 63*b* rotates in a direction as indicated by the arrow, the chamber 85*b* is exposed to the outlet port 69 while at the same time, the plunger is being biased inwardly within sleeve 65. This represents the pumping stroke of the pumping unit. It is seen that the amount of ink displaced by the unit during each pumping cycle is directly dependent upon the angle of the wobble plate 117. As the angle increases, the stroke of the plunger shaft 63 increases, thereby increasing the amount of ink pumped by each unit. The range of deflection of the wobble plate 117 relative to a plane perpendicular to the plunger shaft axis is from zero to approximately thirty degrees.

The angle of deflection of the wobble plate 117 is controlled by a wobble plate adjustment means 59. The wobble plate adjustment means 59 comprises an adjustment screw 129 received in a suitable threaded fitting 131 which is retained in a structural wall 133 of the pump body 45. The adjustment screw 129 is rotated by means of the servo motor 135 and engages a set screw 137 which extends from the wobble plate 117. The servo motor 135 includes a gear 139 attached to a rotating shaft thereof (not shown) which gear 139 meshes with an idler gear 143 having a sectioned shaft 145. The idler gear 143 also engages a spur gear 147 attached to a shaft 149 of a potentiometer 151, the function of which will be explained later.

The sectioned shaft 145 includes spaced side members or fingers 153 having opposed parallel facing surfaces 155, between which is received a blocked end 157 of the adjustment screw 129. The adjustment screw blocked end 157 includes side surfaces 159. The fit between the plunger shaft surfaces 159 and side member surfaces 155 is somewhat loose to allow the adjustment screw block end 157 to slide relative to the sectioned shaft 145 when rotating the spur gear 147.

Figure 3:
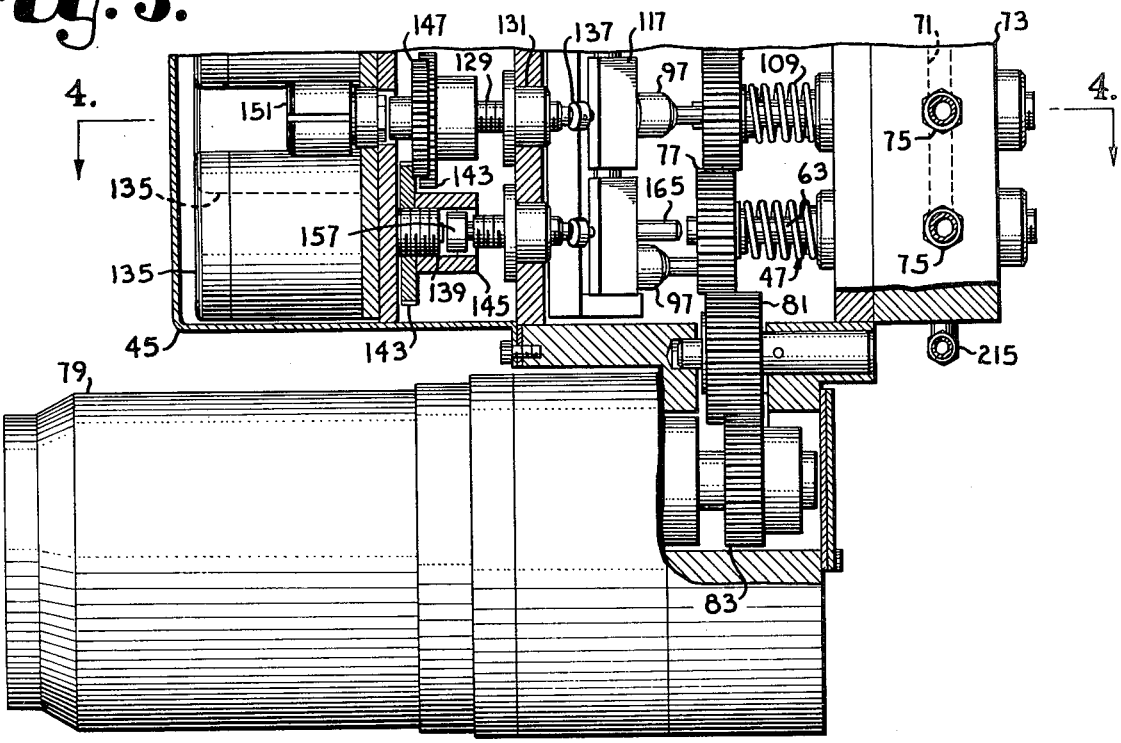
FIG. 3 is an enlarged top plan view of a portion of the ink pump with portions broken away to show details thereof.

As seen in FIG. 3, servo motors 135 associated with adjacent pumping units 147 are staggered in an upwardly and downwardly fashion along with the placement of the potentiometers 151 associated therewith. However, an axis of each of the spur gears 147 lies in a horizontal plane with adjacent spur gears 147 being staggered front to back as seen in FIG. 4. In doing so, this allows a much more compact design for each individual pump body 45.

A positive zero set adjustment screw 165 is provided for each pumping unit 47 and is threadably received within a suitable mounting block 167 extending through an aperture 166 in wobble plate 117. The zero set screws 165 are coaxial with plunger shafts 63 and are adapted to engage an end 169 of the shafts 63 to prohibit any reciprocating action of the plunger shaft by depressing springs 109 so that the sliding shoes 97 do not contact the wobble plates 117. As indicated, the degree of pumping of each individual pumping unit 47 is determined by the angular position of the wobble plate 117. In order to reduce the pumping or reciprocating action of the plungers, it is necessary to rotate the wobble plate 117 to a position shown in FIG. 7 where the wobble plate surface 119 is substantially normal to the plunger axis.

It is extremely difficult to retain such a wobble plate position such that the surface 119 thereof is perfectly perpendicular to an axis of the plunger shaft 63. Because of this, there will always be a small amount of fluid being pumped by each pump unit 45.

Figure 7:
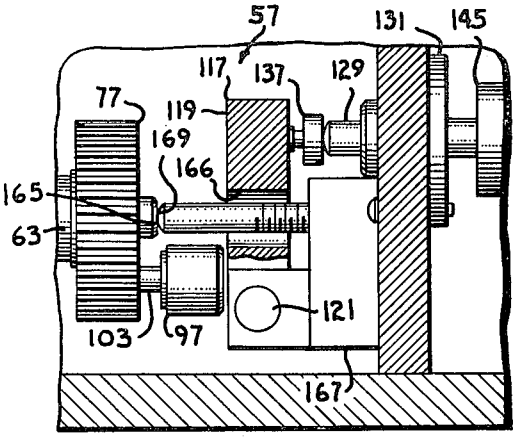
FIG. 7 is an enlarged cross-sectional view of a portion of the ink pump showing the position of the wobble plate, plunger shaft and zero set adjustment screw in operative position.

In order to alleviate this problem, the zero set screw 165 is positioned to engage the plunger shaft end 169 when the wobble plate is moved to the position shown in FIG. 7. The zero set screw 165 comprises a stop means preventing the spring 109 from biasing the sliding shoe 97 into engagement with the wobble plate surface 119. In doing so, the plunger shaft, as it rotates, will not reciprocate and therefore, no pumping action will occur. A suitable lock screw 171 is provided in mounting plate 167 to allow the zero set adjustment screw 165 to be set and securely positioned, as at a factory when constructing the pump body 45.

As indicated, the activation of the servo motors 135 also causes a shaft 149 of an associated potentiometer 151 to rotate. The potentiometer 151 includes suitable variable resistor means (not shown) therein such as are well known in the art, the changing resistance of which is occasioned by the rotation of the shaft 149 as the servo motor 135 is activated to move the wobble plate 117 to a desired angular position. This in turn rotates the potentiometer shaft 149 a corresponding amount of angular degrees changing the resistance therein. The resistance in the potentiometer 151 is calibrated, and the position of the wobble plate 117 can be read out on an associated control panel 175 giving the user of the ink pump 1 instantaneous readings of the positioning of the wobble plates ! 17. Preferably, the readout shown on control panel 117 is of a range from zero to 99 being that percent of the angular deflection of the wobble plate over its given range of possible deflections. When the wobble plate is rotated to where the readout registers zero, preferably the wobble plate is perpendicular to the plunger shaft axis, and the zero set adjustment screw 165 engages the plunger shaft such that there is zero pumping of the associated pumping unit.

Figure 10:
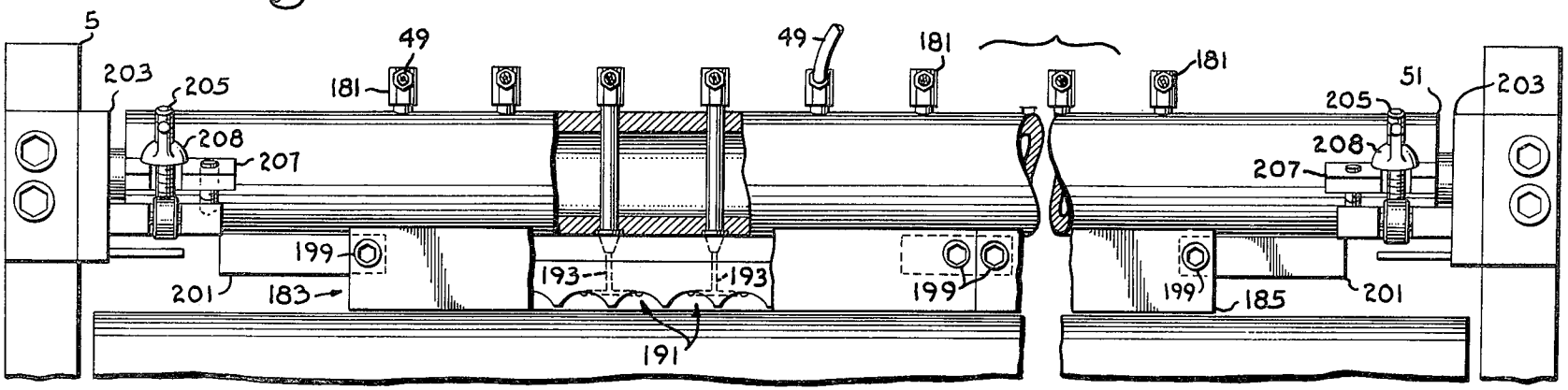
FIG. 10 is a top plan view of an ink rail taken along line 10—10 in FIG. 2 with portions broken away to show details thereof.
Figure 12:
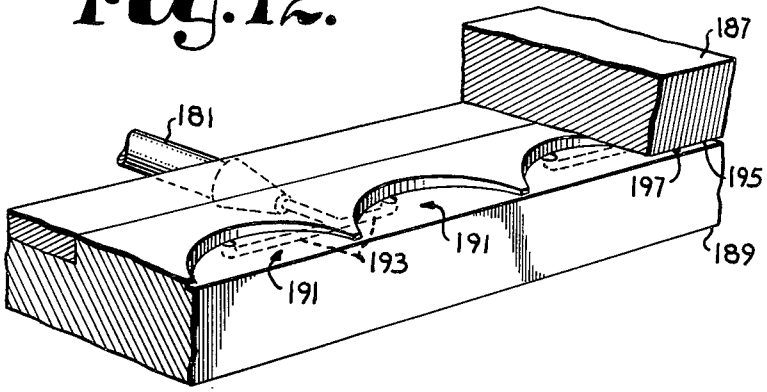
FIG. 12 is an enlarged portion of an orifice plate.
Figure 11:
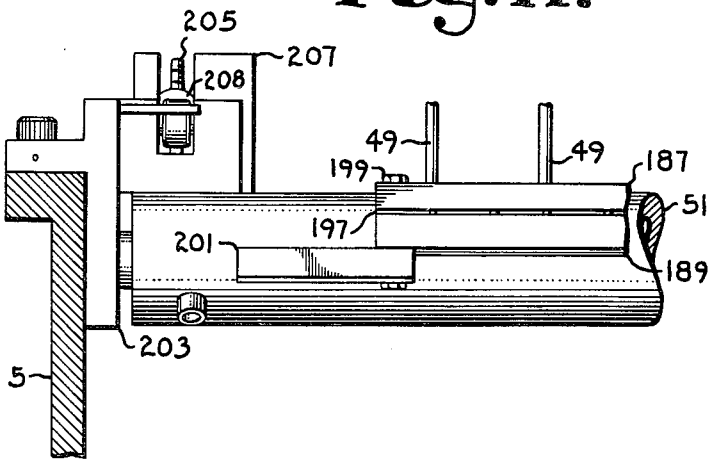
FIG. 11 is an enlarged view of an end portion of an ink rail.

As indicated, the individual pump units 47 pump ink through suitable conduits 49 which are attached to an ink rail 51. As seen in FIG. 10 and FIG. 2, the ink rail 51 extends between the press side frames 5 and retains fittings 181 which are in flow communication with the individual conduits 49. The ink rail 51 further includes an ink presentation means 183, which is adapted to apply the ink to the primary cylinder 29 in a dispersed manner, preferably in a straight line across a total width of the primary roller 29. The ink presentation means 183 comprises groups of orifice plates 185 including upper and lower plates 187 and 189 respectively. The lower plates 189 include scalloped, cut-away portions 191, two of which are in ink flow communication with an individual fitting 181 through suitable passageways 193. The upper orifice plate 187 is preferably flat, and as seen in FIG. 12 near an edge 195 thereof, there exists a linear spacing 197 between the two plates 187 and 189. As ink is pumped through the fittings to the scalloped cutaways 191, it is dispersed outwardly therein and preferably presents a continuous line across the associated primary roller 29.

Each group of orifice plates 185 is attached to the ink rail 51 by means of quickly detachable bolts 199 which extend through mounting brackets 201 of the ink rail. Further, the fittings 181 are readily detachable from the ink rail 51.

The ink rail 51 is retained to the press side frames 5 on bearing blocks 203 which allow the ink rail 51 to rotate about a longitudinal axis thereof. The ink rail 51 is retained in operating position, with the orifice plate edge 195 being adjacent the primary cylinder 29, by retaining means comprising a suitable swing bolt 205 connected to each side frame 5 which retains or captures a forked member 207 attached to the ink rail 51. A swing nut 208 securely engages the forked members 207 to retain the ink rail in operative position.

In the embodiment shown in FIG. 1, the ink pump bodies 45 are slid into an enclosure case 209 and rest on a bottom plate 211 thereof. Suitable quick disconnect electrical fittings 213 are provided for the synchronous motors 79, servo motors 135 and potentiometers 151. Further, each pump body 45 is equipped with a quick disconnect fitting 215 on the intake block 73 to allow quick connection to a suitable source (not shown) of ink. Since most printing is done utilizing black ink with the use of colored ink being small compared thereto, it is envisioned that the printing presses 3 will be equipped with a large black ink source typically in a reservoir found below the printing press 3. Since the pump bodies 45, along with conduits 49, fittings 181 and orifice plates 185, can all be easily removed from the printing presses 3 when it is desired to change colors of ink, it is only necessary to remove those items and install similar items which are associated and used when printing the desired color of ink. This saves the amount of ink which is wasted in a typical conversion between colors, because no purging of the individual pump bodies, conduits, fittings and orifice plates need occur.

Figure 13:
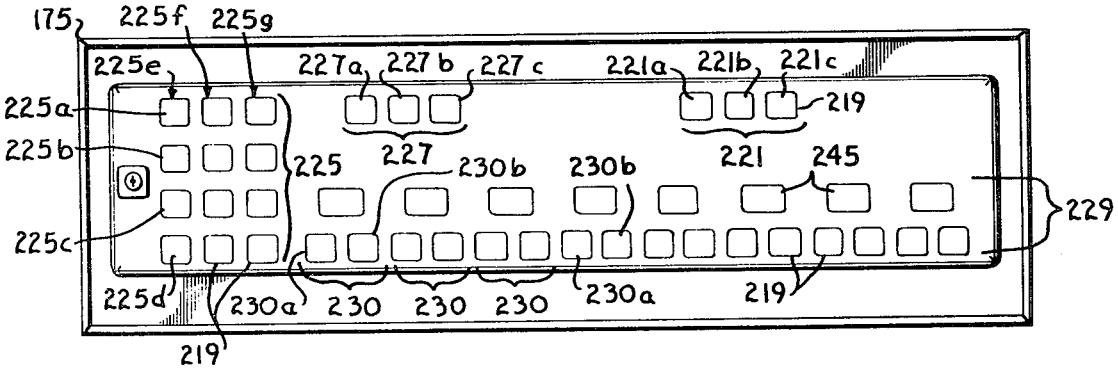
FIG. 13 is a front elevational view of a control panel associated with the ink pump.

The control panel 175 is shown in FIG. 13 containing a plurality of control buttons 219 thereon. By manipulating certain of the control buttons 219, an operator of the printing press can vary the amount of ink pumped by each individual unit 47, by each of the four bodies 45 or by the complete fountain or ink pump 1.

A first set of controls 221 comprising buttons 221*a, b* and *c*, is used to control the amount of ink pumped by the ink pump 1. Button 221*a* is a zeroing button which causes all four DC motors 79 to turn off so that none of the pumping units 47 is activated. Button 221*b* is a decrease button which causes all of the individual pumping units 47 to decrease the amount of ink pumped thereby. This is done by activating each individual servo motor to cause each associated wobble plate to rotate about its support pin 121 to a more vertical position thereby decreasing the length of stroke of each asociated plunger shaft 63. Button 221*c* is an increase button which causes the servo motors 135 to increase the wobble plate angle and therefore increase the amount of ink being pumped.

A second set of control buttons 225 is used to activate and adjust the pumping units of each individual pump body 45. As seen, the second set 225 comprises rows 225*a, b, c*, and *d* and columns 225*e, f*, and *g*. The rows contain buttons which control the function of one of each pumping body. The columnal positioning determines the function of the button. The buttons in column 225*e* turn the individual pump body motors 79 off individually. The buttons in column 225*g* are activated to adjust the various pumping units 47 in each pump body either singularly or collectively as will be explained later. The buttons in column 225*f* activate the individual ink pump in an automatic mode as will also be explained.

As indicated, the rows 225*a, b, c* and *d* represent controls for each pump body 45. Row 225*a* are those buttons which activate the individual pump body 45 which delivers ink to the far side of the web relative to the operator. Rows 225*b* and *c* are those buttons which control the ink pump bodies 45 delivering ink to the far center and near center portion of the web respectively and row 225*d* controls the pump body delivering ink to the near side of the web.

A third set of buttons 227 controls the amount of ink pumped by each pump body 45. A first button 227*a* is used to stop or silence the desired pump body 45 from pumping ink. This occurs by stopping the associated motor 79. A second button 227*b* is used to decrease the amount of ink pumped by each of the pumping units 47 in a desired pump body 45 a certain amount by activating all of the servo motors 135 associated with the desired pump body 45. Likewise, activation of button 227*c* causes the servo motors to increase the amount of ink pumped by the individual pumping units 47 of each pump body 45.

A fourth set of buttons 229 is used to vary the amount of ink pumped by each individual pumping unit 47 in a desired pump body 45. Readouts 245 are provided, as indicated, and display a numeral comprising the percent of pumping being achieved by each pumping unit. The buttons 229 include pairs 230 of which one 230*a* is used to increase the amount of ink to be pumped by the individual pumping unit 47 and 230*b* which is used to decrease the amount of ink pumped by the individual units.

For example, when an operator desires to silence or turn off the far side ink body, he will press the button found in row 225*a* and column 225*e*. If the operator then desires to adjust that ink pumped by each of the individual pumping units 47 in the far center ink body, he will depress or activate the button found in row 225*b* and column 225*g* which indicates the far center ink body is to be adjusted. He will then activate button 227*c* which increases the amount of ink pumped by each individual pumping unit in the far center ink pump.

If the operator desires to adjust the ink pumped by each individual puming unit 47 in the near center ink pump, he will depress or activate the button found in row 225*c* and column 225*g*. Note when activating any of the buttons found in column 225*g*, the individual readouts 245 will indicate the pumping output of each individual pumping unit 47 in the particular ink body 45. When changing the individual pumping units 47, the operator will depress either button 230*a* or 230*b* associated with each pumping unit to selectively increase or decrease the amount of ink pumped by the individual unit 47. The readout 245 constantly provides the operator with the setting of the individual pumping unit associated therewith. In a like manner, all of the individual pumping units can be adjusted as when initially adjusting the ink pump 1 when beginning a new printing run on the press 3.

After all of the pumping units 47 of the ink pump 1 have been adjusted, the operator will depress the buttons found in column **225*f* for those pump bodies 45 which are to be activated. This places the ink pump 1 in an automatic mode wherein each pump body so activated will pump when the press 3** has been activated and is running at a printing speed.

A purge button 251 is provided which activates all of the pump bodies 45 for a given period of time, preferably 10 minutes, when the press is running to purge the conduits and fittings of ink.

Figure 14:
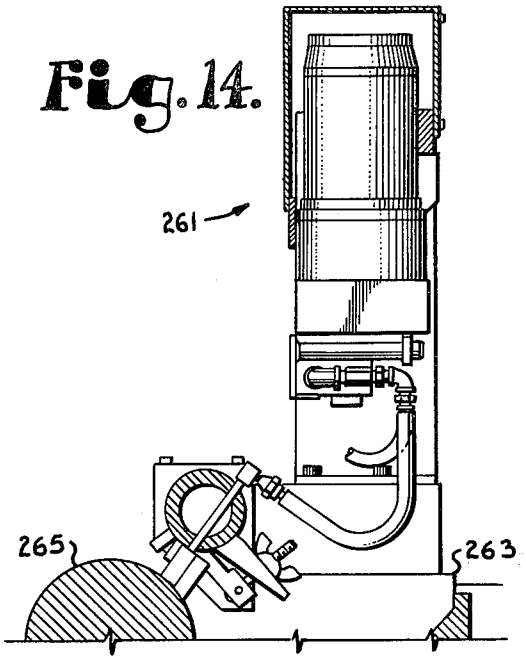
FIG. 14 is a partial cross-sectional view of a printing press showing a different installation of an ink pump according to the present invention.
Figure 8:
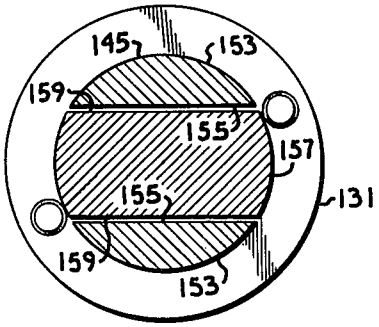
FIG. 8 is an enlarged cross-sectional view showing an adjustment member and servo motor.

In FIG. 14 a second embodiment of an ink pump 261 according to the present invention is shown being mounted in a different location within an associated tower frame 263. At times, it is necessary to mount the ink pump 261 in a position above a primary roller 265 because of space limitations inherent therewith.

It is to be understood that while certain forms of the present invention have been illustrated and described herein, it is not to be limited to the specific forms or arrangement of parts described and shown. What is claimed and desired to secured by letters patent is as follows:

1. In an ink pump adapted to provide a supply of ink to an inking train of a rotary printing press, the ink pump having individual pumping units comprising an elongate plunger shaft having an axis thereof, a first end of which is positioned within an enclosed sleeve defining a pump chamber having inlet and outlet ports therto, and including means to rotate said plunger shaft, the improvement comprising:

(a) said plunger shaft having sliding shoe means positioned near a second end thereof;

(b) a wobble plate having a planar surface angled relative to said plunger shaft axis;

(c) wobble plate adjustment means to cooperate with said wobble plate so as to angularly adjust said wobble plate surface with respect to said plunger shaft axis; and (d) biasing means urging said plunger shaft shoe means toward said wobble plate such that said shoe means are continuously biased into contact with said wobble plate when said ink pump is oppratively pumping, whereby said plunger shaft is urged to reciprocate in said sleeve upon the rotation thereof.

2. In an ink pump adapted to provide ink to an inking train of a rotary printing press, the ink pump having individual pumping units comprising a rotating and reciprocating plunger shaft having an axis thereof and a first end received within a sleeve defining a pump chamber including inlet and outlet ports, said plunger shaft first end having a cut-away portion defining a piston surface for pumping said ink through said outlet port during a pumping cycle comprising a reciprocation stroke and a 360° rotation of said plunger shaft, the improvement comprising:

(a) camming means cooperating with said plunger shaft to impart the reciprocating motion thereto, said camming means having a surface thereon; said camming means surface being selectively adjustable over a range of operative angular positions relative to said plunger shaft axis;

(b) said plunger shaft including shoe means for riding on said camming means surface so as to vary the length of said plunger shaft stroke during said pumping cycle be adjustment of said camming means;

(c) biasing means to urge said plunger shaft into continuous operative contact with said camming means during said pumping cycle throughout said range of operative angular positions; and (d) zero set adjustment means engageable with said plunger shaft to urge said plunger shaft out of operative contact with said camming means, thereby preventing said plunger shaft from reciprocating within said sleeve upon the rotation thereof whereby no ink is pumped by said pumping unit.

3. In an ink pump adapted to provide a supply of ink to an inking train of a rotary printing press, the ink pump having individual pumping units comprising an elongate plunger shaft having an axis thereof, a first end of which is positioned within an enclosed sleeve defining a pump chamber having inlet and outlet ports thereto, and including means to rotate said plunger shaft, the improvement comprising:

(a) a sliding shoe eccentrically attached to a second end of said plunger shaft;

(b) a wobble plate having a planar surface angled rel1ative to said plunger axis;

(c) a biasing means urging said plunger shaft toward said wobble plate such that said sliding shoe is continuously biased into contact with said wobble plate surface whereby said plunger shaft is urged to reciprocate in said sleeve upon the rotation thereof; and (d) said wobble plate being pivotal about an axis normal to and below said plunger shaft axis, and exhibiting a portion above said plunger shaft and a portion below said plunger shaft; said upper portion being generally closer to said sleeve than said lower portion so that, when said plunger shaft is in a position where said sliding shoe contacts said surface of said wobble plate upper portion, said plunger shaft is biased inwardly in said sleeve and, when said plunger shaft is rotated to a position where said sliding shoe is in contact with said surface of said lower wobble plate portion, said biasing means urges said plunger shaft outwardly of said sleeve, thereby providing said reciprocating motion.

4. The improvement as set forth in claim 3 wherein:

(a) said wobble plate is selectively pivotable about a range of angles, relative to a plane perpendicular to said plunger shaft axis, of from zero to thirty degrees.

5. The improvement as set forth in claim 3 including:

(a) an angle adjustment screw threadably received within a mounting and contacting said wobble plate, said adjustment screw including a gear mounted thereon;

(b) a servo motor including selective control means operably engaging said adjustment screw gear for selectively changing the angle of said wobble plate by rotating said screw in said mounting; and (c) a wobble plate position indicator means engaging said adjustment screw including readout means to continuously indicate the position of said wobble plate.

6. The improvement set forth in claim 4 wherein:

(a) said wobble plate position indicator includes a potentiometer having a shaft thereof and a variable resistor therein, the rotation of said shaft changing the value of said resistor, said readout means comprising digital information and being dependent upon the value of said resistor, said potentiometer shaft having a gear thereon engageable with said adjustment screw gear; and (b) said potentiometer resistance and readout information being related to said adjustment screw and wobble plate position such that when said wobble plate is positioned perpendicular to said plunger shaft said readout information comprises a zero and when said wobble plate is biased to a maximum deflected position said readout information comprises the numeral ninety-nine.

7. In an ink pump adapted to provide ink to an inking train of a rotary printing press, the ink pump having individual pumping units comprising a rotating sand reciprocating plunger shaft having a first end received within a sleeve defining a pump chamber including inlet and outlet ports, and a second end; said plunger shaft first end having a cut-away portion defining a piston surface for pumping said ink through said outlet port during a pumping cycle comprising a reciprocation stroke and a 360° rotation of said plunger shaft, the improvement comprising:

(a) camming means contacted by said plunger shaft to impart the reciprocating motion thereto; said camming means comprising:

(1) a planar wobble plate selectively adjustable over a range of angular positions relative to an axis of said plunger shaft, thereby varying the length of said plunger shaft stroke during said pumping cycle; and (2) angular selection means to selectively vary the angle of said wobble plate;

(b) a sliding shoe eccentrically retained on said plunger shaft second end and engageable with said wobble plate;

(c) biasing means to urge said plunger shaft into continuous operative contact with said camming means during said pumping cycle throughout said range of positions; said biasing means comprising a spring positioned between said sleeve and said plunger shaft for urging said sliding shoe into engagment with said wobble plate; and (d) zero set adjustment means comprising a screw; said screw being engageable with and coaxial with said plunger shaft, and positioned relative thereto such that, when said wobble plate is positioned at an angle perpendicular to said plunger shaft axis, said plunger shaft second end engages said zero set adjustment screw for urging said sliding shoe from contact with said wobble plate throughout total rotation of said plunger shaft, whereby said plunger shaft is prevented from reciprocating within said sleeve upon the rotation thereof so that no ink is pumped by said pumping unit.

8. The improvement set forth in claim 7 wherein:

(a) said wobble plate pivots about an axis below and transverse to said plunger shaft axis; and (b) said wobble plate includes a bore therein through which said zero set adjustment screw extends.

9. The improvement set forth in claim 7 wherein:

(a) said wobble plate is deflectable over a range of angles, relative to a plane perpendicular to said plunger shaft axis, of from zero to thirty degrees toward said sleeve.

10. The improvement as set out in claim 8 wherein:

(a) said angle selection means comprises an adjustment screw having an end thereof which contacts a top portion of said wobble plate, said angle adjustment screw being threadably received in a fitting secured to a stationary wall of said ink pump; and (b) said angle adjustment screw is selectively rotated by a servo motor means.

11. The improvement as set forth in claim 10 wherein:

(a) said ink pump includes a control panel having a digital readout associated with each pumping unit which readout displays a number comprising the percentage of deflection of said wobble plate relative to said range of possible angular deflection; and (b) said servo motor operatively engages a potentiometer, the resistance of which is dependent upon the angular position of said wobble plate; said displayed readout number being dependent upon the potentiometer whereby when said wobble plate is adjusted to a position perpendicular to said plunger shaft axis said digital readout displays the numeral zero and when said wobble plate is adjusted to a maximum degree of deflection said readout displays the numeral ninety-nine.

12. A printing press comprising:

(a) a tower comprising two opposed side frames;

(b) a printing couple retained between said tower side frames, said printing couple comprising a plate cylinder having a printing plate thereon and an impression cylinder, said printing couple adapted to transfer an ink image to a web passed through said printing couple, said plate cylinder and said impression cylinder operatively rotating at a first speed of rotation defining a first surface lineal speed;

(c) a source of ink;

(d) an inking train cooperating with said ink source to apply ink to said printing plate, said inking train comprising a plurality of transfer rollers each exhibiting a surface speed equal to said first surface lineal speed;

(e) a fountain roller exhibiting a second surface lineal speed, substantially slower than said first surface lineal speed; said fountain roller spaced from said inking train transfer rollers and in ink transfer communication therewith; and (f) an ink pump communicating with said ink source for applying ink therefrom to said fountain roller; said ink pump comprising:

(1) a number of individual pumping units each having an elongate plunger shaft with an axis thereof, a first end of which is positioned within an enclosed sleeve of said pumping unit; said sleeve and plunger shaft first end defining a pump chamber having inlet and outlet ports thereto; and having means for rotating said plunger shaft;

(2) a sliding shoe eccentrically attached to a second end of said plunger shaft;

(3) a wobble plate having a planar surface angled relative to said plunger axis; said wobble plate surface being angularly adjustable with respect to said plunger axis;

(4) biasing means urging said plunger shaft toward said wobble plate such that said sliding shoe is continuously biased into contact with said wobble plate, whereby said plunger shaft is urged to reciprocate in said sleeve upon the rotation thereof.

* * * * *